US006851291B2

(12) United States Patent
Nunez

(10) Patent No.: US 6,851,291 B2
(45) Date of Patent: Feb. 8, 2005

(54) MOTORIZED LOCKING MECHANISM

(75) Inventor: Paul Nunez, Orange, CT (US)

(73) Assignee: Sargent Manufacturing, New Haven, CT (US)

( * ) Notice: Subject to any disclaimer, the term of this patent is extended or adjusted under 35 U.S.C. 154(b) by 123 days.

(21) Appl. No.: 10/305,650

(22) Filed: Nov. 26, 2002

(65) Prior Publication Data

US 2004/0099026 A1 May 27, 2004

(51) Int. Cl.[7] ..... E05B 47/06

(52) U.S. Cl. ..... 70/283; 70/275; 70/278.7; 70/150

(58) Field of Search ..... 70/283, 275, 278.6, 70/278.7

(56) References Cited

U.S. PATENT DOCUMENTS 4,949,563 A * 8/1990 Gerard et al. ..... 70/299
5,640,863 A * 6/1997 Frolov ..... 70/283
5,678,870 A 10/1997 Pelletier ..... 292/244
5,715,715 A 2/1998 Nunez ..... 70/283
6,038,896 A * 3/2000 Chamberlain et al. ..... 70/279.1
6,145,353 A * 11/2000 Doucet ..... 70/277
6,286,347 B1 * 9/2001 Frolov ..... 70/472
6,363,762 B1 * 4/2002 Kueng ..... 70/278.3
6,427,505 B2 * 8/2002 Imedio Ocana ..... 70/422
6,640,594 B1 * 11/2003 Yao ..... 70/277
6,725,693 B2 * 4/2004 Yu et al. ..... 70/107

OTHER PUBLICATIONS

Drawing of Sargent Keypad Lock Model KP–8276—Exploded View.
Photograph #1—Photograph of Sargent Model No. KP–8276 Keypad Lock.–.
Photograph #2—Photograph of Sargent Model No. KP–8276 Keypad Lock.–.

* cited by examiner

*Primary Examiner*—John B. Walsh
(74) *Attorney, Agent, or Firm*—DeLio & Peterson, LLC

(57) ABSTRACT

A motorized locking mechanism for locking and unlocking a device having a hub rotatable by a handle about a hub axis. A reversible motor turns a threaded spring screw to move a locking spring and vertically drive a connecting arm between locked and unlocked positions. A locking slide is mounted on the connecting arm and pivots parallel to the hub axis. The parallel pivoting motion of the locking slide protects the locking mechanism against damage. If the locking slide is temporarily prevented from moving into or out of locking engagement with the hub, the motor may still turn and the locking spring subsequently moves the locking slide in the desired direction without the necessity of reactivating the motor.

17 Claims, 4 Drawing Sheets

MOTORIZED LOCKING MECHANISM

BACKGROUND OF THE INVENTION

1. Field of the Invention

The present invention relates to locking mechanisms for doors that are locked and unlocked electrically.

2. Description of Related Art

Motorized locking mechanisms are used in applications that require a lock to be operated electrically. Although there are many such applications, one illustrative use is in the outside handle trim for an exit device operated by a keypad. Outside trim of this type is installed on the exterior side of an exit door of a commercial building where the exit door will also be used by authorized personnel to enter the building. The trim piece includes a handle having a spindle that turns a hub. The spindle extends through the exit door and into the exit device mounted on the inner side of the door.

Motorized locks used in this application typically have a motor that drives a locking slide into and out of locking engagement with a hub on a spindle attached to the handle. Turning the handle rotates the hub and opens the door. Preventing the hub from turning locks the trim and prevents access. The hub generally includes a locking notch in its perimeter that receives the locking slide to prevent rotation of the hub and the handle. The motor drives the locking slide into and out of interfering engagement with the locking notch in the hub to lock and unlock the door.

In a keypad-controlled device, the user enters a numeric code into the keypad to open the door. Entry of the correct code energizes the motor and electrically retracts the locking slide from the hub for a short period of time—the "access period". During the access period, the handle may be rotated and the door opened. After the access period, the locking slide is driven back into the hub to relock the exit door and prevent unauthorized entry.

A particular problem with motorized locking mechanisms relates to the forces that can be applied from the hub to the locking mechanism through the locking slide. Particularly when the handle is a lever handle, a very high level of torque can be applied to the hub. This high level of torque can apply a damaging level of force to the internal components of the locking mechanism through the locking slide. The locking slide will attempt to turn with the turning hub in response to forces applied to the handle. This turning motion is not in the direction required to open the door, and is resisted by a counteracting force applied to the locking slide by the mounting of the locking slide. Thus, door security is not compromised.

However, the locking slide may cock or move slightly in undesired ways, particularly under high load levels when the lock mechanism is worn. This undesired motion can drive the motor or other parts of the locking mechanism in undesired and potentially damaging directions and/or apply a damaging level of force to the motorized system for moving the locking slide.

Another problem with motorized designs of this type is that the locking slide may be temporarily prevented from moving to or from the locked position. If the handle is still in the rotated position when the access period expires, the locking slide cannot re-engage the locking notch in the hub. Alternatively, if a turning force is applied to the handle before the access period begins, friction between the hub and the locking slide may prevent the locking slide from being retracted.

It is particularly important that the motorized lock ensure that door is correctly relocked after the access period. Although inconvenient, a user can simply operate the lock again if he has prevented the door from unlocking by prematurely applying a rotational force to the handle. However, if the user has prevented the mechanism from relocking, by keeping the handle rotated beyond the access period, the door will remain unlocked if the motorized lock is incapable of relocking automatically after the handle is released.

One method of achieving automatic relock is to monitor the location of the locking slide and re-energize the motor if the slide has not moved. This method is relatively expensive to implement due to the cost of the sensors and additional electronics required. A related difficulty is that the motor system must be properly designed so that it does not damage itself or any other part of the lock if the motor is energized while the locking slide is prevented from moving.

It is known to provide for automatic relock by using a spring, but in some applications it is preferred for the locking slide to move vertically. The use of a spring for automatic relock of a motor-driven, vertically moving, locking slide has been problematical. The motor and drive mechanism must lift the weight of the locking slide through the spring and prevent it from returning during the access period.

Bearing in mind the problems and deficiencies of the prior art, it is therefore an object of the present invention to provide a motorized locking mechanism that prevents damaging forces from being transferred to the locking mechanism from the device being locked.

It is another object of the present invention to provide a motorized locking mechanism suitable for vertical use.

It is a further object of the present invention to provide a motorized locking mechanism that is modular for easy installation during manufacturing and rapid replacement in the field.

Still other objects and advantages of the invention will in part be obvious and will in part be apparent from the specification.

SUMMARY OF THE INVENTION

The above and other objects, which will be apparent to those skilled in art, are achieved in the present invention which is directed to a motorized locking mechanism for locking and unlocking a device having a hub rotatable by a handle about a hub axis. The motorized locking mechanism includes a reversible motor, a spring screw mounted on the motor shaft and a locking spring having an engaged portion moved by the spring screw between first and second positions to lock and unlock the mechanism.

When the motor rotates the spring screw in one direction, it locks the device. When the motor spins it the opposite way it unlocks the device. The locking mechanism includes a connecting arm mounted for motion between locked and unlocked positions. The locking spring urges the connecting arm towards the locked position when the engaged portion of the locking spring is in the first position. The locking spring urges the connecting arm towards the unlocked position when the engaged portion of the locking spring is in the second position.

A locking slide is driven by the connecting arm through a pivoting connection into and out of interfering engagement with the hub as the connecting arm is moved by the locking spring. The pivoting connection between the locking slide and the connecting arm has an axis of pivot that is parallel to the hub axis to protect the locking mechanism. The locking spring has sufficient spring action to allow the engaged portion of the spring to move to the first position even if the locking slide is prevented from moving to the locked position. The spring action of the locking spring is also sufficient to automatically relock the mechanism by moving the connecting arm to the locked position as soon as the locking slide is free to move.

The motorized locking mechanism is specially designed for vertical operation. The locking spring has sufficient spring action to vertically support the connecting arm and locking slide against the pull of gravity. The spring screw has threads engaging the locking spring, with a sufficiently low pitch and a sufficiently high friction with the locking spring to prevent rotation of the spring screw when the connecting arm and locking slide are supported by the locking spring.

In the preferred design, the locking spring includes two extended locking spring legs that contact the spring screw on opposite sides thereof and exert opposed inward forces on the spring screw. The opposed inward forces are sufficient to prevent the spring legs from separating and passing over the threads of the spring screw.

The locking spring legs are held together in an opening formed in the connecting arm. The opening in the connecting arm has a diameter less than the width of the spring screw which produces opposed inward forces on the spring screw. The level of the opposed inward forces is controlled by the diameter of the opening in the connecting arm. That diameter is adjusted to ensure a sufficiently high level of force to produce a desired level of friction and prevent the springs from jumping over the threads of the spring screw. Conversely, the diameter of the opening in the connecting arm is selected to make sure that the friction and corresponding wear is not too high.

The connecting arm is preferably L-shaped and includes a fork at an end thereof. The locking slide pivots within the fork. Another aspect of the preferred design is that the locking mechanism includes a housing and the connecting arm slides in guide slots formed in opposed inner surfaces of the housing. The housing supports all of the components of the locking mechanism, which allows the entire locking mechanism to be easily removed and replaced as a modular unit.

To prevent the locking spring from being damaged by work hardening and excessive bending, an end of the locking spring opposite the connecting arm is float mounted, preferably between a pair of opposed compression springs.

The spring screw is designed such that the threads are open at opposite first and second ends. The engaged portion of the locking spring reaches the first position when the motor rotates the spring screw in the locking direction for a defined number of turns. The engaged portion of the locking spring exits the first open end of the spring screw threads and remains in the first position when the motor rotates the spring screw in the locking direction for additional turns.

The engaged portion of the locking spring enters the first open end of the spring screw threads and reaches the second position when the motor rotates the spring screw in the unlocking direction for the defined number of turns, without regard to the number of additional turns previously made by the motor in the locking direction. The engaged portion of the locking spring exits the second open end of the spring screw threads and remains in the second position when the motor rotates the spring screw in the unlocking direction for additional turns.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1–4 of the drawings in which like numerals refer to like features of the invention.

Figure 1:
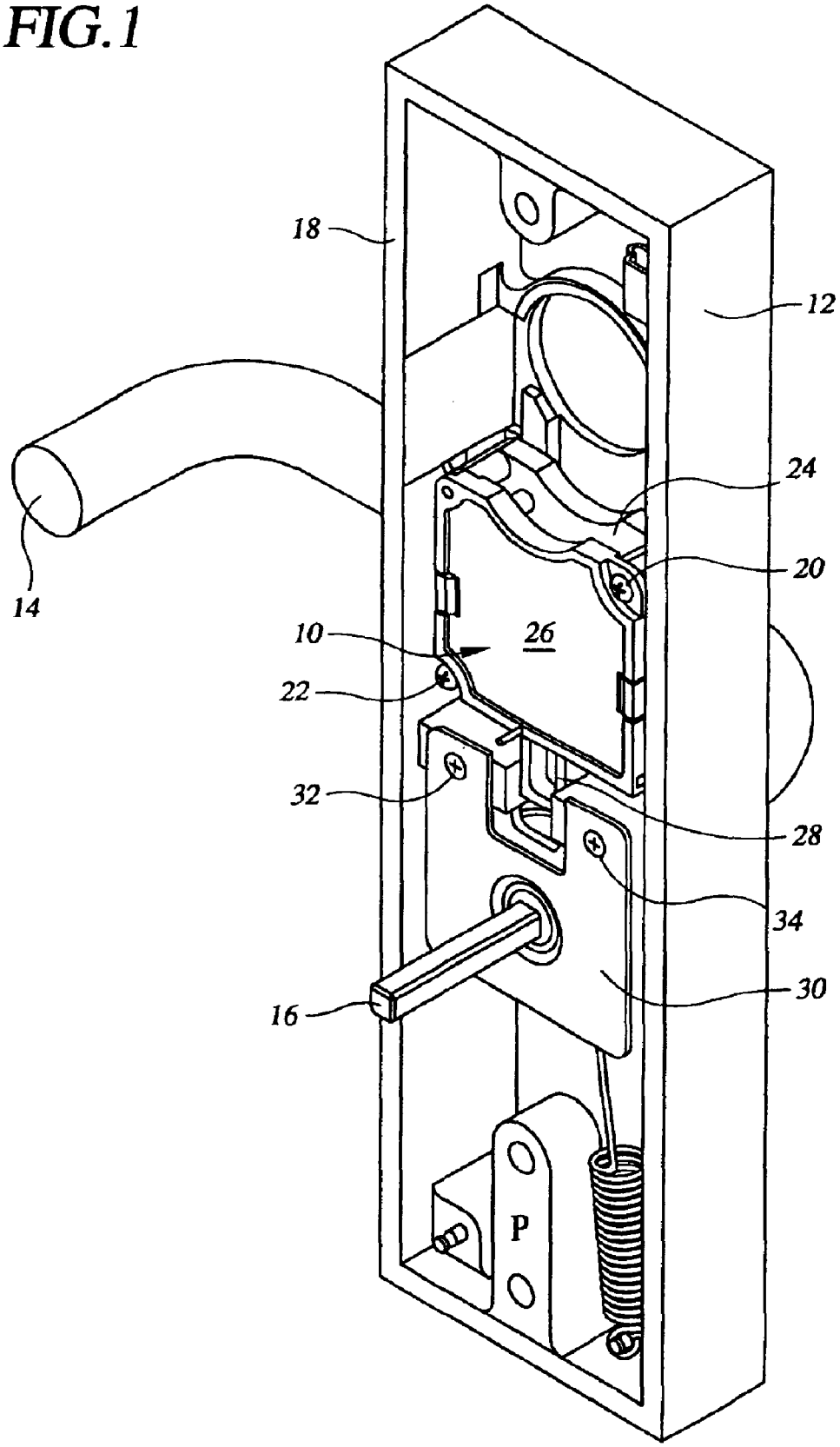
FIG. 1 is a perspective view showing the motorized locking mechanism of the present invention installed in handle trim for an exit device. The back side of the handle trim is shown, i.e., the side normally mounted on the outer side of a door having an exit device mounted on the inner side. The motorized locking mechanism is shown in a modular frame and the cover of the frame obstructs the view of the interior details of the locking mechanism.

Referring to FIG. 1, a motorized locking mechanism 10 according to the present invention is installed within an exit trim housing 12. The exit trim includes a lever handle 14 that rotates a spindle 16 to operate an exit device. The exit trim is installed on the outer side of the exit door with perimeter edge surface 18 flush against the door. The spindle 16 extends through the exit door and into a conventional exit device (not shown) installed directly opposite the trim housing 12 on the inner side of the exit door.

All of the components of the locking mechanism 10 are ultimately mounted to or supported by a frame 24 and its removable front cover 26. The complete locking mechanism can be removed as a modular unit from the housing 12 and replaced by removing two mounting screws 20 and 22. The modular design not only allows the locking mechanism to be easily replaced, it also makes it faster and easier to install during manufacture.

Figure 2:
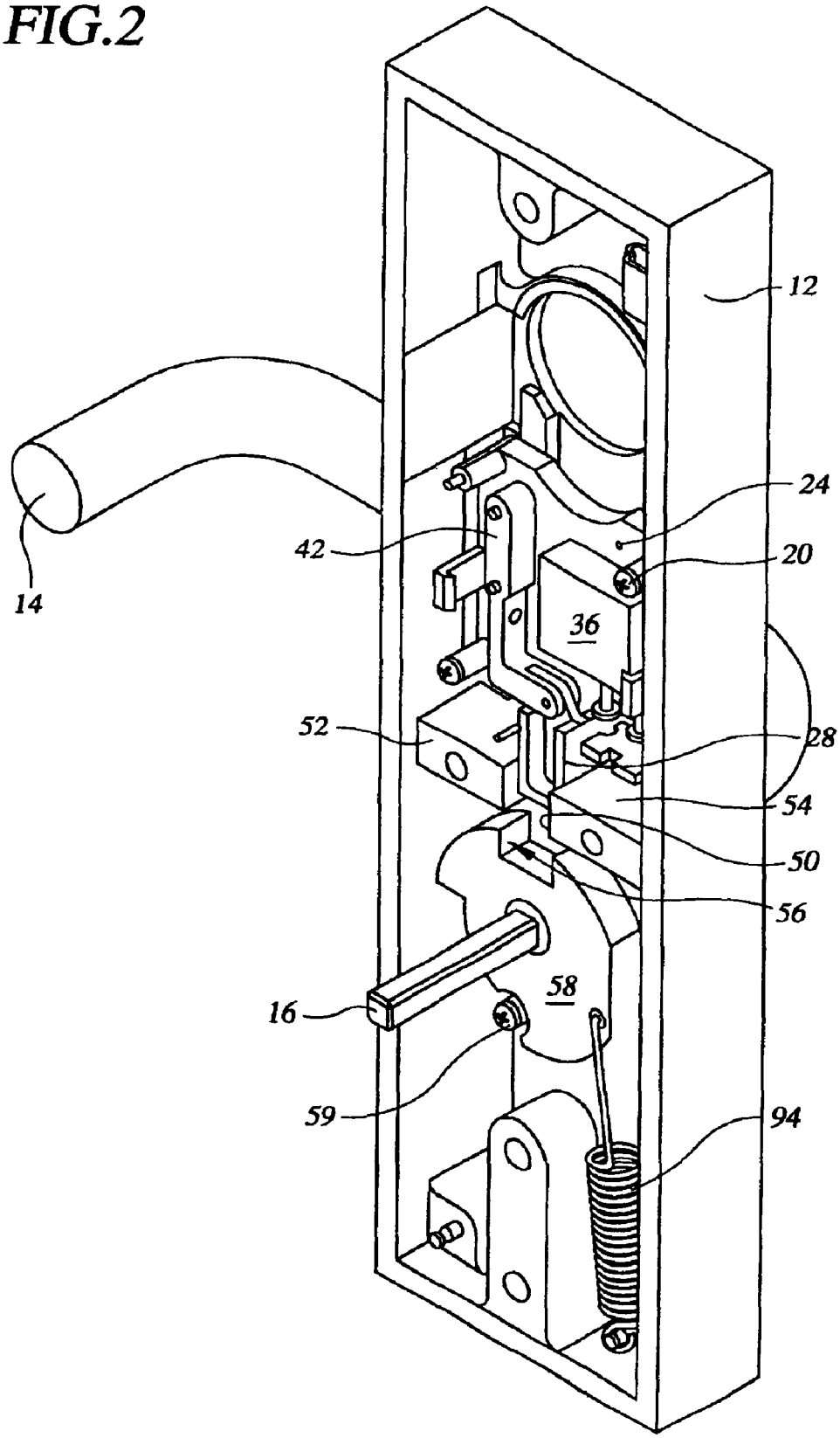
FIG. 2 is a perspective view of the motorized locking mechanism and handle trim substantially as seen in FIG. 1, except that the cover of the modular locking mechanism frame and a cover plate over the hub have been removed to show the operation of the locking mechanism and its interaction with the hub.
Figure 3:
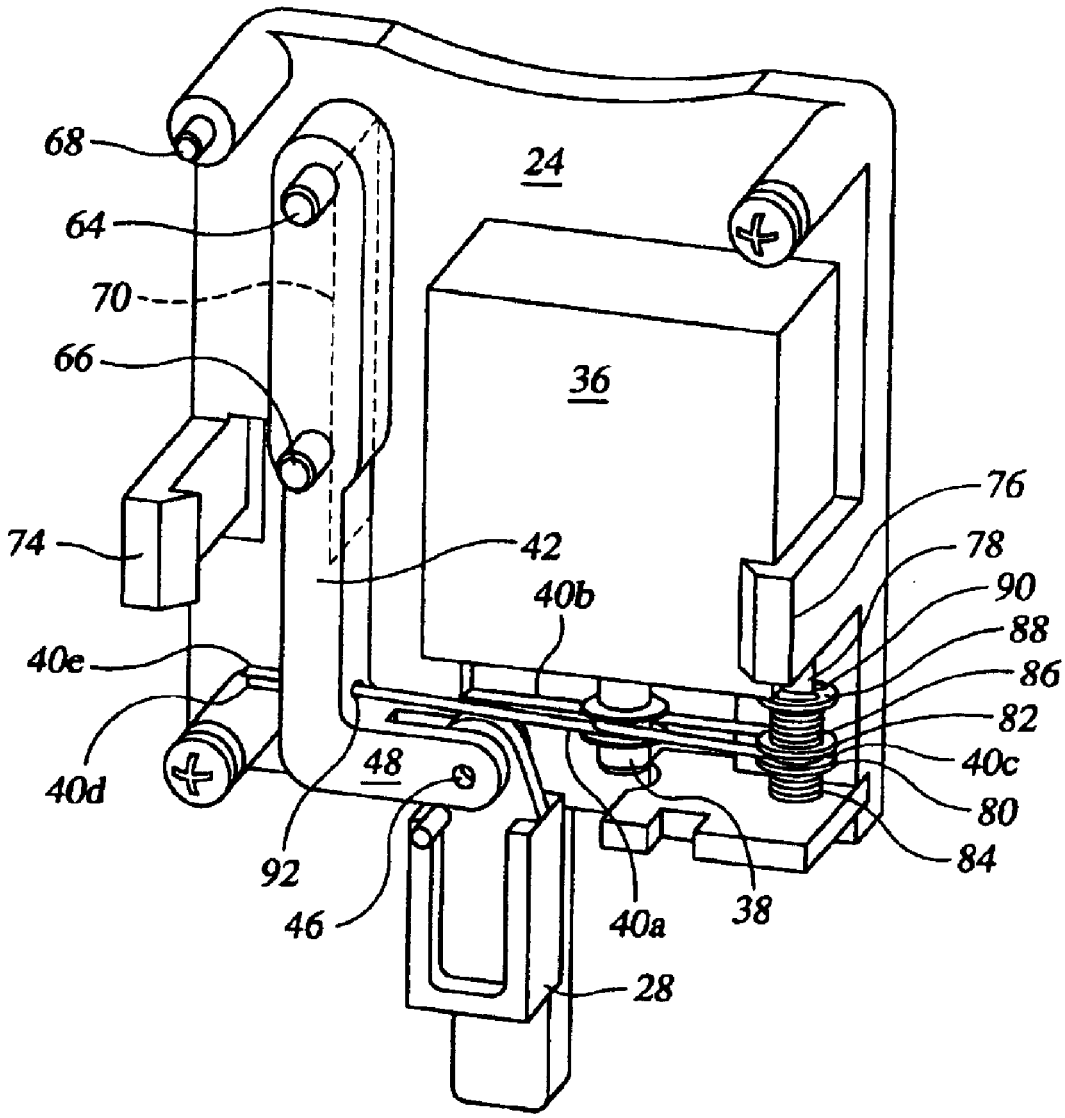
FIG. 3 is a perspective view of the motorized locking mechanism of the present invention at an enlarged scale. The modular frame containing the motorized locking mechanism is shown removed from the handle trim of FIG. 1 and the cover of the frame has been removed to show the interior of the locking mechanism.

Referring also to FIG. 2, the locking mechanism includes a locking slide 28 that extends vertically out of the bottom of the locking mechanism. The locking slide is vertically movable into and out of interfering engagement with a hub 58 mounted on the spindle 16. The hub allows the rotation of the handle and spindle to be controlled by defining the limits of rotation (with post stop 59) and by locking the hub against any rotation (with locking slide 28). A hub cover plate 30 (FIG. 1) is removable by removing screws 32 and 34.

In FIG. 2 the front cover 26 of the locking mechanism 10 and the hub cover plate 30 have been removed to show the components of the locking mechanism and the interaction between them. The locking mechanism 10 includes a motor unit 36 oriented with the shaft of the motor extending vertically down. The shaft has a spring screw 38 mounted on it. The spring screw includes threads that engage a locking spring 40 and move it up and down (see FIG. 3).

The motor 36 is reversible between a locking direction (counter-clockwise when viewed from the top of FIGS. 1–3) and an unlocking direction (clockwise). The locking spring 40 is composed of two locking spring legs 40*a* and 40*b* that pass on opposite sides of the spring screw and are engaged by the threads thereof. When the motor 36 spins in the locking direction the threads on the spring screw 38 drive the engaged locking spring legs 40*a*, 40*b* down.

End 40*c* of the locking spring 40 floats in a semi-stationary position between opposed compression springs 84 and 86. On the opposite side of the spring screw, ends 40*d* and 40*e* of the locking spring legs extend into a common opening 92 in a vertically slidable connecting arm 42. When the spring screw 38 is rotated in the locking direction, ends 40*d* and 40*e* of the locking spring slide the connecting arm 42 downward towards the hub 58. When the spring screw rotates in the opposite direction, the locking spring lifts the connecting arm 42 up and away from the hub.

The locking slide 28 swings on a pivot 46 in a fork 48 formed on the end of the connecting arm 42. Pivot 46 allows the locking slide 28 to rotate about a pivot axis that is parallel to the axis of rotation of the spindle 16. This pivoting action between the locking slide and the connecting arm, parallel to the axis of rotation of the hub, protects the locking mechanism against damage as described below.

As can be seen in FIG. 2, the locking slide 28 extends through a locking opening 50 formed in the trim housing 12 by a pair of opposed heavy duty stops 52 and 54. When the spring screw drives the connecting arm 42 down, the locking slide 28 moves into interfering engagement with locking notch 56 in the hub 58. The stops 52, 54 act to guide the locking slide vertically and limit its motion to ether side when engaged by the hub 58.

Figure 4:
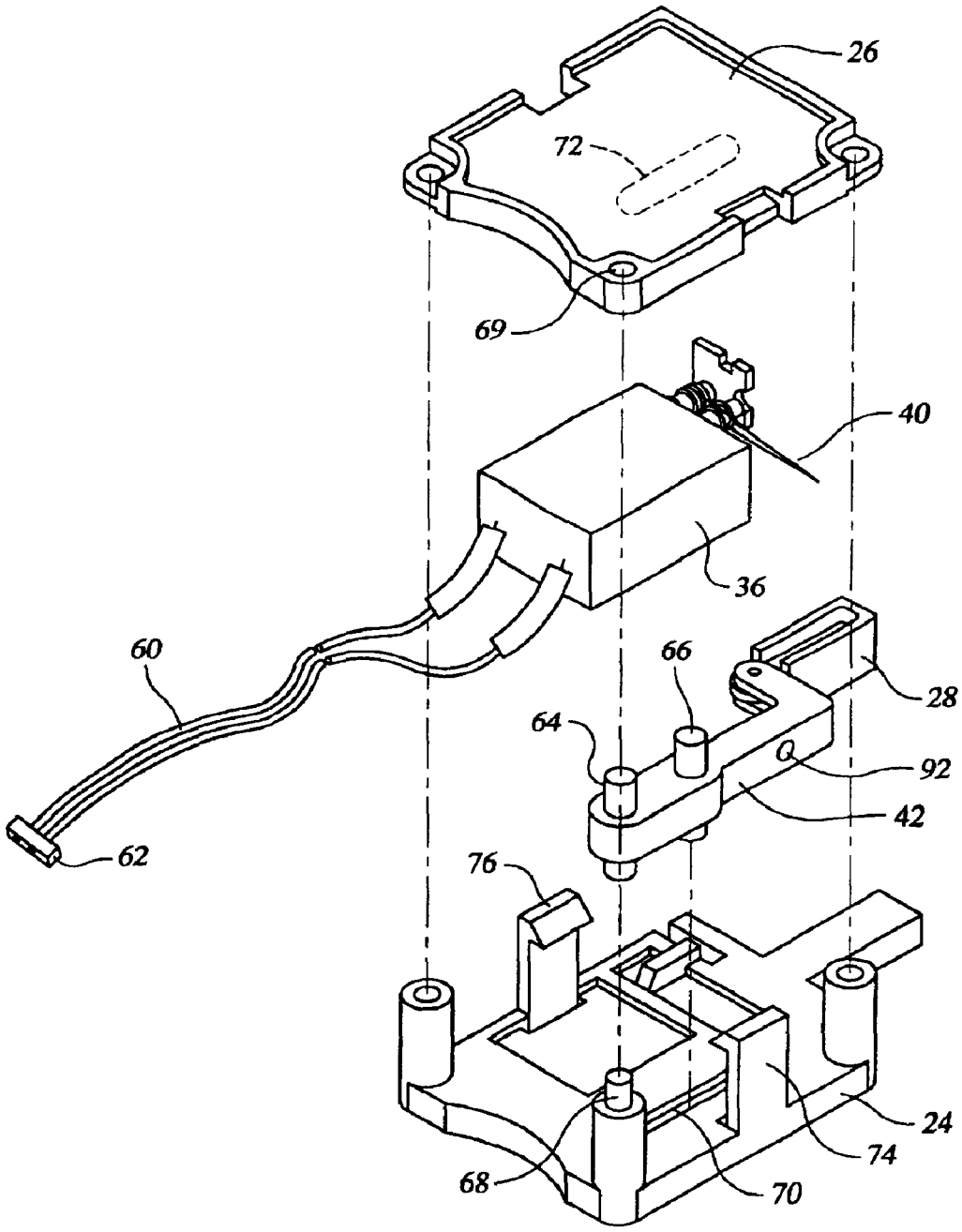
FIG. 4 is an exploded view of the motorized locking mechanism of the present invention.

Referring to FIG. 4, the motor 36 is electrically controlled through cable 60, which includes a plug 62 that is connected to an exit device control unit (not shown) on the interior side of the exit door. The cable 60 extends through an opening in the exit door and into the control unit. Typically, a keypad mounted near the trim housing 12 on the exterior side of the door will also connect to the exit device control unit. If a valid authorization code is entered into the keypad, the control unit will spin the motor 36 in the unlocking direction. This lifts the connecting arm 42 and removes the locking slide 28 from interfering engagement with the locking notch 56 in the hub 58. After a predetermined access period of time, during which the handle may be turned and the door opened, the control unit will reverse the motor 36 and spin it in the locking direction to relock the hub.

The connecting arm 42 is supported on two bearing rods 64 and 66 that extend perpendicularly through the connecting arm 42 and into guide slots 70, 72 on opposite sides of the connecting arm. One guide slot 70 is formed in the frame 24 of the locking mechanism. The opposite guide slot 72 is formed on the inner surface of the cover 26. The opposed guide slots 70, 72 trap the opposite ends of the bearing rods 64 and 66 to guide the connecting arm in the desired vertical sliding motion. The connecting arm is free to slide vertically over a limited range under the influence of pressure from the locking spring 40, but is prevented from moving in other directions.

The locking mechanism cover 26 is oriented by pin 68 on the frame that engages a corresponding hole 69 in the cover. The cover is snapped onto the frame 24 and is held in position by snap latches 74 and 76. With the cover snapped into position, guide slot 70 in the frame 24 will be directly opposite guide slot 72 in the cover 26.

End 40*c* of the locking spring 40 engages a vertical pin 78. Spring washer 80 is directly below end 40*c* and spring washer 82 is directly above end 40*c*. Compression spring 84 exerts an upward force against spring washer 80 while compression spring 86 exerts a downward force on spring washer 82. Spring washer 88 and C ring 90 hold the assembly together onto vertical pin 78.

This spring mounting arrangement generally holds end 40*c* of the locking spring in a floating mount that allows end 40*c* to move slightly as the engaged central portions of the spring arms 40*a* and 40*b* are driven by the spring screw 38. This floating mount prevents the locking spring from bending excessively and work hardening or breaking after extended use.

The locking spring legs 40*a* and 40*b* extend on opposite sides of the spring screw 38 and pass through opening 92 in the connecting arm 42. The diameter of opening 92 is preferably less than the diameter of the spring screw so that the locking spring legs 40*a*, 40*b* apply opposed inwardly directed forces against the spring screw. The opposed inward forces keep the locking spring legs engaged with the threads of the spring screw 38.

If the diameter of opening 92 is increased, the inward opposed forces applied by the locking spring legs is decreased. If the diameter is increased, the inward force is decreased. Decreasing the inward force decreases friction between the locking spring and the spring screw and decreases wear. However, it also makes it easier for the spring legs to jump out of the threads in the spring screw. Conversely, increasing the inward force increases friction and wear, but makes it more difficult for the spring legs to jump over the spring screw threads.

The diameter of opening 92 is selected for the optimum desired balance between these characteristics to permit proper operation in the vertical direction. The inward force applied by the locking spring legs to the spring screw must be sufficiently low that excess wear is avoided and the motor is able to spin the spring screw. However, the inward force must be sufficiently high that the locking spring legs are retained in the threads of the spring screw and there is no tendency of the spring legs to disengage or jump over the threads. Moreover, a limited amount of friction is desirable as it ensures that there will be no tendency for the spring screw to rotate after the connecting arm 42 has been lifted when the weight of the connecting arm and locking slide are being vertically supported by the spring screw through the locking spring.

The centering action of the compression springs 84 and 86 on the end 40*c* of the locking spring must also be selected to ensure that end 40*c* of the locking spring does not move significantly when the opposite ends 40*e* 40*d* are supporting the weight of the connecting arm 42 and the locking slide 28.

Referring to FIG. 2, it can be seen that the locking slide 28 locks the mechanism only when it extends into the locking notch 56. If the handle 14 is continuously held down while the locking slide is out of the locking notch, the motor 36 will be unable to return the locking to locking engagement with the locking notch. Alternatively, if a downward force is applied to the handle when the locking slide is engaged, the slide will be trapped and cannot be retracted from the locking notch.

Even when the locking slide cannot move, however, the motor 36 is still able to rotate the spring screw 38 and drive the engaged portions of the locking spring legs 40*a*, 40*b* up or down. The locking spring has sufficient spring action that it can always flex in response to motion of the spring screw and the inward force applied by the spring legs is always sufficient to keep the spring legs engaged in the threads of the spring screw. Thus, the spring screw can always drive the locking spring legs between a first upper position and a second lower position.

If the locking slide cannot return to the locking notch when the spring screw has driven the spring legs to the lower second position, the locking spring will continuously apply a downward force to the connecting arm 42. As soon as pressure on the handle 14 is released, return spring 94 rotates hub 58 and lifts handle 14 back to the horizontal position. This realigns the locking notch 56 with the locking opening 50 and the locking spring 40 will drive the connecting arm and locking slide downward. This mechanically relocks the lock mechanism without the necessity of operating the motor again or sensing the location of the connecting arm and locking slide.

Conversely, the locking slide is occasionally trapped in the locking notch when a downward force is prematurely applied to the handle. Nonetheless, the spring screw can still drive the spring legs to the upper position, and the locking spring will then continuously apply an upward force to the connecting arm 42. If pressure on the handle 14 is released during the access period, the upward force on the connecting arm will immediately retract the locking slide and allow the handle to turn.

When an attempt is made to turn the handle while the locking slide is in the locking notch, the hub attempts to rotate the locking slide. Although this rotation is resisted by the stops 52, 54, which locks the handle, the locking slide will still move slightly in a direction transverse to its normal vertical sliding motion. This transverse motion will increase as the locking slide and the stops become worn. This transverse motion attempts to apply an undesirable transverse force to the connecting arm through the locking slide 28.

The axis of the pivot 46 in the lower end 48 of the connecting arm is parallel to the axis of rotation of hub 58 and spindle 16. The pivot 46 acts to allow the locking slide 28 to swing on the pivot axis and move slightly in the transverse direction relative to the connecting arm. This swinging action and limited transverse motion of the locking slide prevents destructive levels of transverse force and torque from propagating back into the lock mechanism and thereby protects it from damage. The connecting arm and motor are also further protected by the L-shape of the connecting arm.

In the preferred design, the spring screw 38 only needs to turn two complete turns to move the spring legs from the lower position to the upper position. However, it is not necessary for the motor to turn exactly two turns. The motor can be turned on continuously, or it can be turned on only briefly. Provided that it makes at least two turns, the engaged sections of the spring legs will move from the upper position to the lower position, or vice-a-versa.

The spring screw is designed such that the threads are open at the bottom and the top. The engaged portion of the locking spring reaches the upper position when the motor rotates the spring screw in the locking direction for at least two turns. The engaged portion of the locking spring exits the upper open end of the spring screw threads and remains in the upper position when the motor rotates the spring screw in the locking direction for more than two turns.

The engaged portion of the locking spring enters the upper open end of the spring screw threads and reaches the lower position when the motor rotates the spring screw in the unlocking direction for at least two turns, without regard to the number of turns previously made by the motor in the locking direction. The engaged portion of the locking spring exits the bottom open end of the spring screw threads and remains in the lower position when the motor rotates the spring screw in the unlocking direction for more than two turns.

This design with open ends of the spring screw allows the motor to overrun the minimum two turns required by as many turns as desired. This design greatly simplifies motor control as it is not necessary to track or control the number of turns made by the spring screw.

The pitch of the spring screw threads is sufficiently shallow and the friction between the spring screw and the locking spring (as set by the diameter of the opening 92) is sufficiently high that there is no tendency for the spring screw to self-rotate or allow the locking slide to descend when the weight of the slide and the connecting arm are supported on the locking spring.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A motorized locking mechanism for locking and unlocking a device having a hub rotatable by a handle about a hub axis, the motorized locking mechanism comprising:

a reversible motor having a shaft;

a spring screw mounted on the shaft, the motor rotating the spring screw in a locking direction to lock the device and in an opposite unlocking direction to unlock the device;

a locking spring having an engaged portion moved by the spring screw towards a first position when the motor rotates the spring screw in the locking direction and towards a second position when the motor rotates the spring screw in the unlocking direction;

a connecting arm mounted for motion between locked and unlocked positions, the locking spring urging the connecting arm towards the locked position when the engaged portion of the locking spring is in the first position and the locking spring urging the connecting arm towards the unlocked position when the engaged portion of the locking spring is in the second position; and a locking slide driven by the connecting arm through a pivoting connection, the pivoting connection having an axis of pivot parallel to the hub axis, the locking slide interferingly engaging the hub to prevent rotation of the hub and lock the device when the connecting arm is in the locked position and the locking slide disengaging from the hub to allow rotation of the hub and unlock the device when the connecting arm is in the unlocked position, the pivoting action of the locking slide parallel to the hub axis operating to limit the transmission of damaging forces from the hub to the connecting arm;

the locking spring having sufficient spring action to allow the engaged portion of the spring to move to the first position when the connecting arm is prevented from moving to the locked position by misalignment between the hub and the locking slide, the spring action of the locking spring being sufficient thereafter to move the connecting arm to the locked position when the hub is aligned with the locking slide.

2. The motorized locking mechanism for locking and unlocking a device according to claim 1 wherein the locked and unlocked positions of the connecting arm are vertically separated and the connecting arm is mounted for vertical motion between the locked and unlocked positions.

3. The motorized locking mechanism for locking and unlocking a device according to claim 2 wherein the locking spring vertically moves the connecting arm and the locking slide, the locking spring having sufficient spring action to vertically support the connecting arm and locking slide against the pull of gravity.

4. The motorized locking mechanism for locking and unlocking a device according to claim 3 wherein the motor shaft is vertical and the spring screw has threads engaging the locking spring, the spring screw threads having a sufficiently low pitch and a sufficiently high friction with the locking spring to prevent rotation of the spring screw when the connecting arm and locking slide are supported by the locking spring.

5. The motorized locking mechanism for locking and unlocking a device according to claim 1 wherein the connecting arm slides vertically and the locking spring includes two extended locking spring legs having corresponding engaged portions comprising the engaged portion of the locking spring, the engaged portions of the spring legs contacting the spring screw on opposite sides thereof and exerting opposed inward forces on the spring screw, the opposed inward forces being sufficient to prevent the spring legs from separating and passing over threads of the spring screw.

6. The motorized locking mechanism for locking and unlocking a device according to claim 5 wherein the locking spring legs have ends held in an opening formed in the connecting arm, the opening having a diameter less than a width of the spring screw whereby the spring legs exert the opposed inward forces on the spring screw.

7. The motorized locking mechanism for locking and unlocking a device according to claim 6 wherein the diameter of the opening in the connecting arm holding the locking spring legs is selected for proper operation and is sufficiently large to reduce friction between the spring screw and the locking spring to allow rotation of the spring screw and sufficiently small to exert a desirable level of opposed inward forces to prevent the spring legs from separating and passing over threads of the spring screw.

8. The motorized locking mechanism for locking and unlocking a device according to claim 7 wherein the locking spring continuously holds the connecting arm in the unlocked position and vertically supports the locking slide and connecting arm.

9. The motorized locking mechanism for locking and unlocking a device according to claim 1 wherein the connecting arm slides between the locked and unlocked positions.

10. The motorized locking mechanism for locking and unlocking a device according to claim 9 wherein the connecting arm is L-shaped.

11. The motorized locking mechanism for locking and unlocking a device according to claim 10 wherein an end of the L-shaped connecting arm has a fork, the locking slide pivoting within the fork of the connecting arm.

12. The motorized locking mechanism for locking and unlocking a device according to claim 9 further including a housing, the connecting arm sliding in guide slots formed in opposed inner surfaces of the housing.

13. The motorized locking mechanism for locking and unlocking a device according to claim 12 wherein the housing is a modular unit removably fastenable to the device whereby the locking mechanism is removable as a complete unit.

14. The motorized locking mechanism for locking and unlocking a device according to claim 1 wherein the locking spring includes an end opposite the connecting arm that is float mounted.

15. The motorized locking mechanism for locking and unlocking a device according to claim 14 wherein the float mounting of the locking spring comprises a pair of opposed compression springs.

16. The motorized locking mechanism for locking and unlocking a device according to claim 1 wherein:

the spring screw includes threads engaging the locking spring, the threads being open at opposite first and second ends of the spring screw;

the engaged portion of the locking spring reaches the first position when the motor rotates the spring screw in the locking direction for a defined number of turns;

the engaged portion of the locking spring exits the first open end of the spring screw threads and remains in the first position when the motor rotates the spring screw in the locking direction for additional turns, the engaged portion of the locking spring enters the first open end of the spring screw threads and reaches the second position when the motor rotates the spring screw in the unlocking direction for the defined number of turns, without regard to the number of additional turns previously made by the motor in the locking direction; and the engaged portion of the locking spring exits the second open end of the spring screw threads and remains in the second position when the motor rotates the spring screw in the unlocking direction for additional turns.

17. The motorized locking mechanism for locking and unlocking a device according to claim 16 wherein the housing is a modular unit removably fastenable to the device whereby the locking mechanism is replaceable as a complete unit.

* * * * *